United States Patent [19]

Armitage et al.

[11] Patent Number: 4,647,215

[45] Date of Patent: Mar. 3, 1987

[54] RAGLESS PROPELLER DRAFT TUBE MIXER

[75] Inventors: Jack R. Armitage, Kearns; Ralph B. Haymore, Salt Lake City, both of Utah

[73] Assignee: Envirotech Corporation, Salt Lake City, Utah

[21] Appl. No.: 837,979

[22] Filed: Mar. 10, 1986

Related U.S. Application Data

[62] Division of Ser. No. 533,831, Sep. 19, 1983, Pat. No. 4,575,256.

[51] Int. Cl.[4] ..... B01F 5/12

[52] U.S. Cl. ..... 366/266; 366/323; 366/343; 415/213 C; 416/176

[58] Field of Search ..... 366/262, 264, 266, 265, 366/270, 263, 279, 318, 323, 342, 343; 415/213 C, 72, 73; 416/176, 177; 308/187, 187.1

[56] References Cited

U.S. PATENT DOCUMENTS

| | | | |
|---|---|---|---|
| 543,909 | 8/1895 | Thompson . | |
| 658,678 | 9/1900 | Roseborough . | |
| 1,015,540 | 1/1912 | Butow . | |
| 1,307,106 | 6/1919 | Armstrong . | |
| 1,498,783 | 6/1924 | Clark . | |
| 1,892,182 | 12/1932 | Thayer . | |
| 2,038,221 | 4/1936 | Kagi | 266/34 |

OTHER PUBLICATIONS

Columbian Hydrosonic Style I Brochure, p. 3, dated pre-1981.

Process Engineers Drawing 11313 and Material List dated Aug. 26, 1955.

Process Engineers Drawing 11395 and Material List dated May 8, 1955.

Process Engineers Drawing 12595 and Material List dated Sep. 11, 1957.

EIMCO Brochure Type RDT, p. 13, dated pre-1981.

Michigan Wheel Corp. Brochure ©1983.

*Primary Examiner*—Robert W. Jenkins

*Attorney, Agent, or Firm*—Thomas S. MacDonald; Alan H. MacPherson; Carl Rowold

[57] ABSTRACT

A draft tube mixer is disclosed particularly adapted for use with digestion processes and apparatus wherein a vertical shaft (13) is driven by motor (15) through a suitable drive (14) to rotate a ragless propeller (12). The propeller (12) has a series of three lobes or blades (40–42) which are concentrically arranged at 120° apart positions so that the minimum diameter of the blades are at the ends of a hub (43) from which the blades integrally extend. The blades extend over the length of the hub over about a 360° of rotary motion helix. The blades (40–42) are symmetrical from their ends to the mid points on the vanes from either direction top or bottom so that the propeller is reversible without loss of efficiency. The leading edge (50) of each of the blades regresses from a point from the start of the blade progression tangent to the outside of the hub at each end so that this falling away of the angle of attack of the blade causes any debris striking the blade, such as rags or string to fall away outwardly of the blade hub so that it does not ball up or otherwise adhere to the hub area.

20 Claims, 9 Drawing Figures

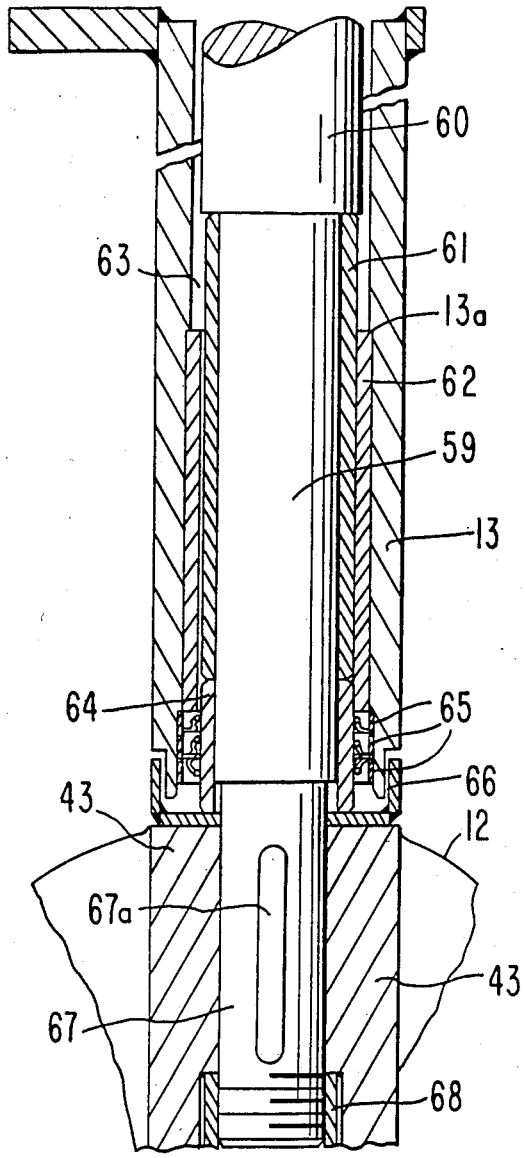
FIG. 7
FIG. 8
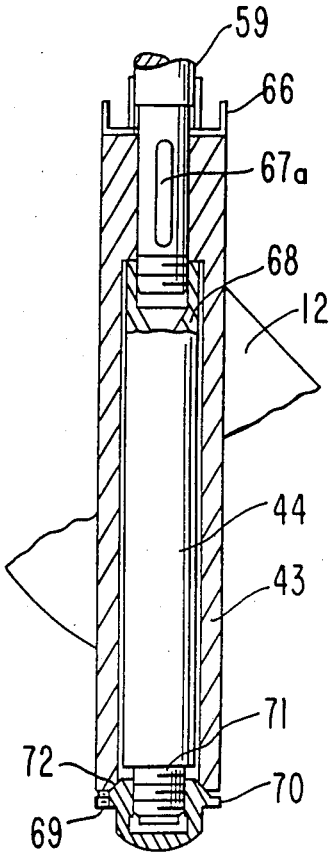
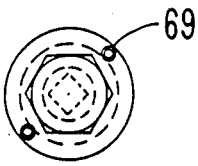
FIG. 9

RAGLESS PROPELLER DRAFT TUBE MIXER

CROSS REFERENCE TO RELATED APPLICATION

This application is a divisional application of Ser. No. 533,831 filed Sept. 19, 1983 resulting in U.S. Pat. No. 4,575,256, issue date Mar. 11, 1986.

BACKGROUND OF THE INVENTION

1. Field of the Invention

The present invention generally relates to a draft tube-type mixer including a propeller which pumps relatively large volumes of sludges or slurries and is positioned generally within or without a tank. In the case of anaerobic digestion of sewage sludges, these mixers act as low head, high volume sludge pumps and utilize a motor to drive a vertically-oriented sludge mixing propeller.

2. Description of the Prior Art

Draft tube mixers per se have been constructed and used for various applications, including high rate digestion processes, for many years. These devices include a draft tube(s) positioned within a digestion or other tank, which has a vertically mounted marine-type propeller or other paddle-like mixing vanes rotable with a vertical shaft driven by a motor. The motor and propeller are normally uni-directional in operation i.e. pumping either upwardly or downwardly. Prior art motors are sometimes reversible in order to try to "clear" or flush-off a propeller which has become fouled from rags, string or other debris or to put a marine vehicle in reverse. In reverse there is normally a large sacrifice in efficiency. The propellers used in most cases were designed for clean water use and have relatively short hub lengths. The construction is such as to cause unwanted materials (e.g. string and rags) which enter onto the inner 85–90% of the blade height to move toward the propeller hub. This results in those materials wrapping around the hub in a large ball. This increases the blade leading edge causing a reduction in pumpage and an increase in power draw. When the propeller is reversed it has been found that not much of the unwanted materials actually flushes off. Various marine-type propellers have two or more lobes or blades which have a root tracing a spiral or helical generatrix along a horizontal shaft hub. These are seen in U.S. Pat. Nos. 543,909 with uniform width blades; 1,015,540 with bifurcated ends; 1,307,106 with ends only attached to a shaft; 1,498,783 with a ichthyoidal hub profile; and 1,892,182 with concave/convex blade faces to direct water to the center of the propeller.

The problem of protecting pumps from rags and other unwanted material has also been solved to some degree by using recessed impellers. Such pumps however are not efficient in pumping the large volumes needed in draft tube mixers and do not perform satisfactory mixing.

SUMMARY

The present invention provides a draft tube mixer having an improved propeller which precludes accumulation of debris such as rags or string around the propeller blades or hub. The propeller design permits forward and reverse motor operation. The normally vertically mounted symmetrical propeller is rotated either in a clockwise or counter-clockwise direction to pump fluid from the bottom to the top of the draft tube or vice versa with equal efficiency. The draft tube and propeller provides for low head loss and effective utilization of mixing energy. In use with anaerobic digestion, effective sludge mixing is provided with strong surface agitation to effect scum break-up. The high degree of mixing intensity effectively eliminates short circuiting and increases the active digester volume.

These improvements are accomplished by providing a preferably three-lobed pump having warped blades in which the leading edge "falls away" or regresses from its point of tangency with the propeller hub so that any debris striking the blades falls away outwardly of the blade hub and rags, string or other debris cannot ball up on the hub.

The propeller of this invention can be any pitch with any diameter. It may be a so-called square propeller having the same diameter as length or have a longer hub than diameter. The blades of the invention are symmetrical from the top to the lengthwise center-line and from the bottom to the lengthwise center-line so that they are mirror-images of each other and have equal efficiency in either direction of rotation without losing pumping capacity. The preferred embodiment of the propeller is cast so as to avoid any protuberances or structures on which debris can be snagged, which would be existent in bolted or welded structures. Casting allows for a stronger and cleaner design where the blade root areas are blended or faired into the hub.

A further feature of the improved draft tube mixer is an oil column lubricated lower bearing for the propeller shaft. Conventional mixers are equipped with lower bearings which are mounted either just above liquid level or submerged just above the propeller level and are grease lubricated or sludge lubricated. Digesters operate at pressures greater than atmospheric pressure. The pressure within the shaft shield is atmospheric. The tank internal pressure from the digester gas is constantly trying to force the sludge through the lower seals into the bearing. The sludge is very gritty. This grit combined with water flushing the grease out of the bearing will cause the destruction of the bearing in a short period of time. Having the bearing above the liquid level causes bearing contruction problems and necessitates a long cantilevered shaft. The present invention provides a bearing located adjacent to the propeller for best support, and provides a pressure inside the shaft shield which is always greater than that in the mixing area due to a high column or head of oil. The internal oil pressure head is greater than the pressure on the outside of the mixer; thereby making it almost impossible for the sludge to enter through the seals to the bearing area. The bearing is submerged in oil all the time with minimal chance that sludge water can flush it out. A further feature of the invention is that the shaft shield is a smooth pipe from a flange above liquid level down to the propeller. This eliminates any possibility of rags and strings building up on the shaft and interfering with the pumpage rate. In contrast, most other draft tube mixers have flanges with associated bolts and grease lines below liquid level, which make ragging a real problem. Lastly, an improved means to connect the propeller to the shaft hub is disclosed for locking the propeller radially, axially and torsionally on the shaft.

BRIEF DESCRIPTION OF THE DRAWING

FIG. 7 is a partial cutaway cross-sectional elevation view of the lower bearing for the propeller shaft.

FIG. 8 is a partial cutaway cross-sectional elevation view of the propeller hub and propeller-to-shaft locking means.

FIG. 9 is a bottom end view of the locking means of FIG. 8.

DETAILED DESCRIPTION

The present invention finds particular utility in the mixing of sludges in anaerobic sludge digestion processes. Effective digester mixing enhances the anaerobic digestion process, while inadequate or improper mixing causes difficulties such as reduced rates of volatile solids destruction, gas production, rapid scum accumulation and foaming. Thickening of sludges to be anaerobically digested has become a common practice. Combining sludge thickening with adequate digester mixing reduces the volume required for effective digestion and makes the process less subject to upset. Digesters normally comprise cylindrical tanks and have a fixed digester cover thereover. Bouyant covers are also utilized which are designed to move vertically thus allowing large liquid level variations. Sludge mixers are vertically oriented devices which may be mounted so they depend from the digester cover or they may be in flow communication with the tank interior through appropriate flow conduits through the vertical walls of the digester tank so as to move and mix slurry liquor from the bottom to the top or vice versa in the digester tank. Multiple mixers may be used in one digester if necessary to give satisfactory mixing.

When tank contents are not vigorously mixed, stratification may occur and the tank volume is not effectively utilized. The sludge mixers of this invention minimize scum formation, distribute heat more evenly throughout the digester, completely mix the digester contents and evenly distribute volatile acids and nutrients. These mixers act as low-head, high volume sludge pumps utilizing especially designed vertical sludge mixing propellers which may operate in either direction maximizing system flexibility. The propellers prevent fouling and preclude accumulation of debris in the mixer.

Figure 1:
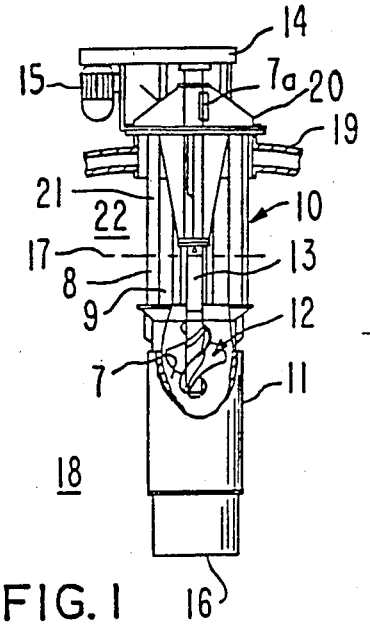
FIG. 1 is a partially cutaway side elevation view of an upward or downward discharging draft tube mixer depending from a digester tank cover.

As seen in FIG. 1 the draft tube mixer 10 comprises a cylindrical draft tube 11 which depends into the fluid level 17 in a fluid-holding tank (not shown). The propeller 12 of the invention depends from the interior of a shaft housing 13 and is attached to a propeller shaft which is connected to belt-driven pulley subsystem 14 rotated by a reversible motor 15. In most applications the motor is an explosion proof motor rated from about 5 to 20 horsepower and is designed to pump up to about 20,000 gallons per minute. The mixer assembly 10 is shown mounted by suitable platform means 20 in an aperture at the top or other location in a digester cover 19. The propeller 12 and an inlet or outlet extension 16 of the draft tube is positioned within the fluid 18 to be pumped below fluid level 17. The propeller of this invention in conjunction with the draft tube prevents accumulation of scum in the volume 22 above the fluid level 17 and the tank cover 19. As shown, the blades have edges between a first end position to the midpoint position which are concave relative to a straight line between those two positions. Likewise, the edge from the other blade end position to the midpoint position is concave relative to a straight line between those two positions. Propeller 12 may be operated in either clockwise or counterclockwise direction so that the inlet 16 may function as (1) an outlet with the fluid being conveyed downwardly by pump suction from upper fluid levels in the tank, through vertical apertures 9 in a cage 8 supporting draft tube 11 in depending relation from platform 20, down through the propeller and draft tube or (2) an an inlet with fluid flow in the "up" direction through tube 11 and propeller 12. Operation of the propeller may be over a wide RPM range dependent on application. In a digester process use, a preferred range is from about 200 to about 400 RPM.

Figure 2:
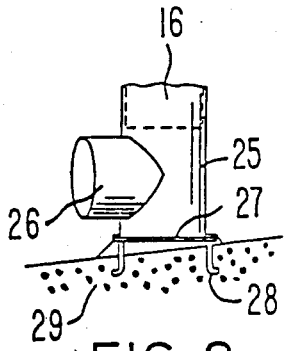
FIG. 2 is a side elevation view of the bottom of a tangentially discharging mixer.
Figure 3:
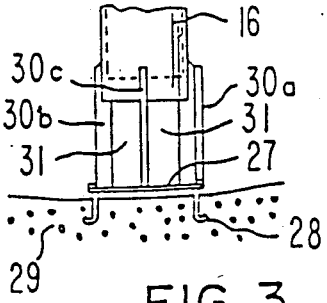
FIG. 3 is a side elevation view of the bottom of a radially discharging mixer.

As can be seen in FIGS. 2 and 3 the discharge from outlet 16 may typically be tangentially through an extension 25 and exit portion 26 or through a series of vertical apertures 31 extending between vertical rails 30 a, b and c. The rails mount the draft tube outlet 16 to the bottom 29 of the digester tank by means of a deflector platform 27 held by embedded bolts 28 in the digester bottom.

Figure 4:
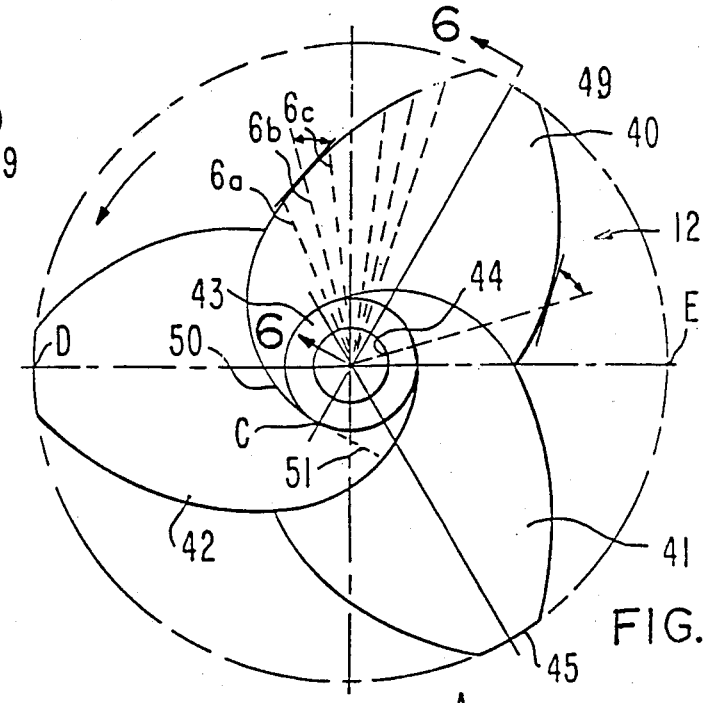
FIG. 4 is a top view of the ragless propeller of this invention.
Figure 5:
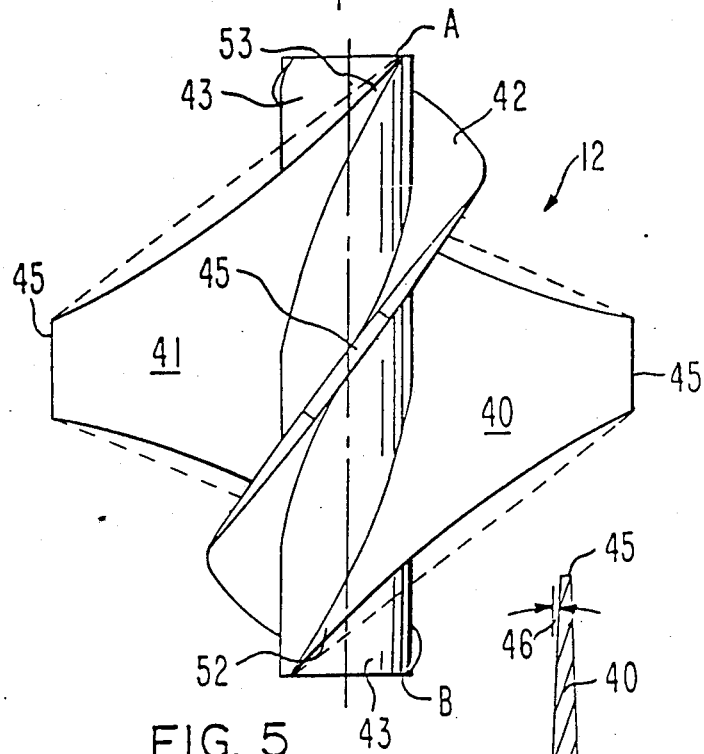
FIG. 5 is a side elevation view of the propeller of FIG. 4.

The propeller of this invention is seen in detail in FIGS. 4 and 5. Referring to FIG. 4 the propeller contains three lobes 40, 41 and 42 mounted on a propeller hub 43 which contains a central bore 44 to receive a suitable propeller drive shaft. Each of the lobes 40–42 is faired into the hub and has minimum blade diameters at the extremities of the hub at a first position as at point A in FIG. 5 and extends at varying diameter the length of the hub to be faired in at a third position (point B) at the opposite end also at minimum blade diameter. Each of the lobes is positioned one hundred twenty degrees (120°) around the hub 43 as it spirals around the hub and has a maximum diameter at a second position at the mid-point between points A and B on the hub. As can be seen in FIG. 4 leading edge 50 of lobe 40, for example, sweeps back or regresses from its point of tangency C at its point of attachment or start on shaft 43. Tangent 51 forming point C is at right angles to a radial line at that point through the center of bore 44. It is seen that tangents to radials *6a*, *6b* and *6c* have in a downstream direction an acute angle to an outward extension of the radials. The regressing blade leading edge 50 functions to mechanically force any solid or stringy material or other debris away from hub 43. The radial lines *6a*, *6b*, *6c*, etc., further illustrate the regression of the leading edge. Any stringy or solid material will move toward the tip of the blade and is flushed off. Natural centrifugal force also removes material from the propeller blades. Unlike the normal marine propeller there is no leading edge ahead of the point where contact is made on the blade to stop outward movement away from the hub.

While the invention has been described in terms of a preferred three-lobed propeller, the lobe numbers may be variable in quantity. The lobes of the propeller are cast integrally with the hub 43 so that there are no obstructions or nicks or protuberances on which debris may catch or entwine.

As can be seen more clearly in FIG. 5 the blades are symmetrical as one progresses from point A to the mid point between points A and B. Likewise the blades are symmetrical from point B to the mid point between points A and B. This construction is also clearly shown by the propeller 12 in FIG. 1. Each of the blades has a flat 45 at its exterior periphery adjacent its position at essentially the mid point of hub 43 and at maximum blade diameter to provide for sufficient clearance with the inside surface 7 of draft tube 11 (FIG. 1). The face and backside of each blade are identical, thus there is no change in efficiency when the propeller is rotated in either direction and used to pump in either up or down direction.

The blades have a higher pitch close to the hub than at the blade tip. This difference in pitch produces a plug flow through the propeller, i.e., for one revolution of the propeller, a particle being pumped at the blade tip will move axially the same amount as a particle being pumped at the hub.

The propeller of FIG. 5 has a length from point A to point B generally equal to the diametrical width between the tips 45 of the blades 40 and 42 radially across the propeller, i.e., from Point D to Point E. Thus the propeller illustrated is of the so called "square" type wherein the length and diameter are essentially equal. In its preferred embodiments the propeller is 24" diameter and 24" long (hub length) or 36" diameter and 36" long. In other embodiments the propeller blades extend over a two to three feet extent of the hub length or axis but have a smaller diameter, for example 18 inches. These relatively long propeller heights mean that rags under 24" (or 36" in the latter case) cannot extend from one leading edge to the other and will not wrap around the propeller from top to bottom. Few rags or pieces of debris are longer than 24" in length. Having a long propeller hub of the order of about two feet to about three feet tends to prevent fibrous material from hanging on to the propeller. Fibrous material could only hang on to the propeller of this invention if it were to catch on a nick on the leading edge of the blade and then wind itself around the blade and hub until it came to the trailing edge of the blade. There would also have to be a nick in the trailing edge for the fiber to be caught in or when the propeller is stopped turning, the water continuing past the blade would wash it off.

Figure 6:
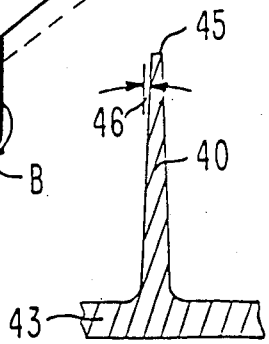
FIG. 6 is a section of a propeller lobe taken on the line 6—6 of FIG. 4 which has been rotated 90° CCW.

FIG. 6 is a cross-sectional view of the the blade 40 taken at its mid point. It extends integrally with hub 43 to the flat 45 at its outer periphery at the mid point of the blade length. The blade has a taper 46 extending from its root portion of its tip portion.

A further important feature of this invention is the provision of a special bearing configuration. The mixer upper bearing (not shown) is conventional and is located well above liquid level next to the motor. An oil lubricated lower bearing is provided adjacent the propeller and prevents ingress of digester or other material into the propeller bearing. Using this configuration bearing span is increased and overhung loads are negligible resulting in extended bearing life.

The shaft housing 13 (FIG. 7) contains a rotating shaft 60 connected to the driving motor as shown in FIG. 1. A shaft extension 50 integral with shaft portion 60 extends to a key shaft 67 containing a keyway **67*a* for attachment of propeller hub 43. A steel wear sleeve 61 surrounds the shaft extension 59 and plastic bearing (which may be of a high density high molecular weight material) or bronze bearing sleeve 62 concentrically surrounds the wear sleeve. The plastic bearing is vertically held by a ridge 13*a* on the interior periphery of shaft housing 13. A column of oil 63 extends from the top of the seals 65 upwardly along the shaft 60 to a position adjacent platform 20 (FIG. 1) to an oil filler port and sight glass 7*a* providing a head of oil over the shaft seal 65 with sufficient head pressure so as to prevent the ingress of deleterious material to the sleeve bearing from the bottom of the bearing. The height of the oil column is such that the oil level pressure is greater than the internal pressure in the digester which depends on the job requirement. A wear sleeve 64 which may be ceramic coated extends from the bottom surface of bearing sleeve 62 to a seal plate or a labyrinth shield 66 to provide a tortious path for any particles seeking to enter into the bearing areas. Rotary oil seal means 65 of conventional construction is positioned between the lower periphery of shaft housing 13 and the outer periphery of the wear sleeve 64. Wear sleeve 64** is typically made of steel material and the ceramic coating may be METCO 450 prime and METCO 136-F top coat which is a chromium oxide silica powder available from METCO, Inc., Westbury, N.Y., or other known composition.

The above construction of bearing and seal allows the lower bearing to be positioned juxtaposed immediately above the propeller hub thus providing maximum bearing support for the propeller and hub combination. This obviates having a long cantilevered shaft extending from a bottom lower bearing or placing the lower bearing submerged below the liquid level and above the propeller level and necessitating grease or sludge lubrication. Since digesters operate at pressures greater than atmospheric pressure the head of oil in the described bearing which is greater than the operating pressure of the digester prevents the flow of grit and other contaminating materials into the bearing. Likewise the oil prevents any water flushing out of the bearing during operation. The bearing is therefore submerged in oil all the time with minimal chance that sludge water or grit can enter and cause damage. As can be seen in FIG. 7 the shaft shield 13 is a pipe of smooth exterior from any flange above the liquid level down to the propeller hub. This eliminates any real possibilities of rags and strings building up and interfering with the pumpage rate. This is distinguished from prior art designs which incorporate flanges and associated bolts and grease lines below liquid level thus making ragging a real problem.

FIG. 8 shows a preferred mode of affixation of the propeller hub 43 to the shaft extension 59. The internal hub and propeller are placed in abutment with shield 66 and keyed to the shaft extension preventing radial displacement by placing a key in keyway **67*a* in the shaft extension. An adaptor bar 68 is threadedly connected to the bottom of shaft extension 67 and extends the interior length of hub 43. Threaded end 71 of bar 68 extends from the hub and a centering and locking nut 70 is threaded thereon. This nut centers the shaft 67 and adapter 68 within the bore of the hub 43 utilizing conical surface 72, acts to axially lock the propeller and hub combination against shield 66 and itself is locked in place from torsional movement when held in place by set screw 69 extending into the end periphery of hub 43**.

The above description of embodiments of this invention is intended to be illustrative and not limiting. Other embodiments of this invention will be obvious to those skilled in the art in view of the above disclosure.

We claim:

1. A draft tube mixer for a tank adapted to hold fluid to be mixed, comprising:

a draft tube;

a driven shaft;

a propeller secured to an end of the shaft;

said shaft and propeller being mounted in the draft tube for pumping fluid in the tank through the draft tube, with the propeller and a portion of the shaft being adapted to be positioned below the surface of the fluid in the tank;

bearing means in the draft tube adjacent to the propeller for mounting the shaft for rotation, said bearing means including a fixed shaft housing surrounding at lease said portion of the shaft;

seal means between the shaft and the shaft housing for closing an end of the shaft housing adapted to be immersed in the fluid of the tank for forming a bearing cavity between the shaft and the shaft housing for holding liquid lubricant and for blocking the flow of lubricant out of the bearing cavity and the flow of tank fluid into the bearing cavity; and means for pressurizing the lubricant at the seal means to a pressure greater than the pressure of the tank fluid at the seal means for further preventing flow of tank fluid into the bearing means to extend bearing life.

2. A draft tube mixer as set forth in claim 1 wherein the shaft extends from a point above the surface of the tank fluid down into the tank fluid, with said bearing cavity extending up from the seal means to an elevation such that the hydrostatic pressure of the lubricant at the seal means is greater than the hydrostatic pressure of the tank fluid at the seal means and thus the column of lubricant held in the bearing cavity thus constituting said means for pressurizing.

3. A draft tube mixer as set forth in claim 2 further comprising a means for protecting the seal means against contact by solids which may be entrained in the tank fluid while enabling fluid communication of the tank fluid to the seal means.

4. A draft tube mixer as set forth in claim 3 wherein the means for protecting comprises a tubular sleeve member surrounding the lower end of the shaft housing but spaced therefrom and extending from a level below to a level above the lower end of the shaft housing to provide a passage between the sleeve member and the exterior of the shaft housing enabling fluid flow therethrough but blocking passage of solids.

5. A draft tube mixer as set forth in claim 4 wherein the shaft housing has a recess at its lower end extending around the periphery of the housing, and said sleeve member is mounted in said recess, with the exterior of the sleeve member being generally flush with the exterior of the shaft housing above the recess therein.

6. A propeller mixer for a tank adapted to hold fluid to be mixed, comprising:

a driven shaft;

a propeller secured to an end of the shaft;

said shaft and propeller being mounted for pumping fluid in the tank, with the propeller and a portion of the shaft being adapted to be positioned below the surface of the fluid in the tank;

bearing means in the draft tube adjacent to the propeller for mounting the shaft for rotation, said bearing means including a fixed shaft housing surrounding at least said portion of the shaft;

seal means between the shaft and the shaft housing for closing an end of the shaft housing adapted to be immersed in the fluid held in the tank for forming a bearing cavity between the shaft and the shaft housing for holding liquid lubricant and for blocking the flow of lubricant out of the bearing cavity and the flow of tank fluid into the bearing cavity; and means for pressurizing the lubricant at the seal means to a pressure greater than the pressure of the tank fluid at the seal means for further preventing flow of tank fluid into the bearing means to extend bearing life.

7. A draft tube mixer as set forth in claim 6 wherein the shaft extends from a point above the surface of the tank fluid down into the tank fluid, with said bearing cavity extending up from the seal means to an elevation such that the hydrostatic pressure of the lubricant at the seal means is greater than the hydrostatic pressure of the tank fluid at the seal means and thus the column of lubricant held in the bearing cavity thus constituting said means for pressurizing.

8. A draft tube mixer as set forth in claim 7 further comprising a means for protecting the seal means against contact by solids which may be entrained in the tank fluid while enabling fluid communication of the tank fluid to the seal means.

9. A draft tube mixer as set forth in claim 8 wherein the means for protecting comprises a tubular sleeve member surrounding the lower end of the shaft housing but spaced therefrom and extending from a level below to a level above the lower end of the shaft housing to provide a passage between the sleeve member and the exterior of the shaft housing enabling fluid flow therethrough but blocking passage of solids.

10. A draft tube mixer as set forth in claim 9 wherein the shaft housing has a recess at its lower end extending around the periphery of the housing, and said sleeve member is mounted in said recess, with the exterior of the sleeve member being generally flush with the exterior of the shaft housing above the recess therein.

11. A propeller adapted to pump fluid which may contain debris, such as string or rags, in either direction with equal pumping efficiency while remaining free of fouling by the debris, comprising:

a generally cylindrical hub having a longitudinal axis, said hub being of generally uniform diameter along its length;

a plurality of blades at generally equal intervals around the hub, each blade extending in a helix along the hub from a first position at one end of the hub to a third position at the other end of the hub and transversing a rotational angle of over 180° but not more than about 360° between said first and third positions, each said blade being faired into the hub at said first and third positions;

each blade further having an outer edge extending in the direction of the longitudinal axis of the hub from said first and third positions to a second position generally midway between said first and third positions;

said outer edge further extending radially outwardly relative to the hub from points on the surface of the hub at said first and third positions to a point of maximum propeller diameter at said second position, with each point on the edge between said first and second positions being spaced radially outwardly from the hub a greater distance than the points on the edge closer to the first position and with each point on the edge between said third and second positions being spaced radially outwardly a greater distance than the points on the edge closer to the third position; and said outer edge also extending annularly relative to the hub such that a line of tangency for each point on the edge between said first and second positions and between said third and second positions is at an acute angle relative to a radial line through the point, with said acute angles for all points on the edge between said first and second positions being at one side of the respective radial lines, and said acute angles for all such points on the edge between said third and second positions being at the opposite side of the respective radial line.

12. A propeller as set forth in claim 11 wherein the propeller is symmetrically shaped with respect to a radial plane through the second position of the blades.

13. A propeller as set forth in claim 11 wherein the axial length of the propeller is approximately at least as great as the maximum diameter of the propeller.

14. A propeller as set forth in claim 11 wherein the propeller is of one-piece construction, with the blades being integrally formed with the hub.

15. A propeller as set forth in claim 11 wherein, as to each blade, the edge of the blade at said second position is truncated and is configured as a segment of a cylindrical surface of revolution defined around the longitudinal axis of the hub at the maximum diameter of the propeller.

16. A propeller as set forth in claim 11 wherein, as to each blade when viewed in traverse section, the blade is in the shape of a generally isosceles triangle.

17. A propeller as set forth in claim 16 wherein the face presented at one side of each said blade is symmetrical to the face presented at the other side of the blade.

18. A propeller as set forth in claim 11 wherein, as to each blade, the edge thereof between said first and second positions is concave relative to a straight line between said first and second positions, and the edge thereof between said third and second positions is concave relative to a straight line between said third and second positions.

19. A propeller as set forth in claim 11 wherein, as to each blade when viewed in section on a radial plane through the blade, the pitch of the leading face of the blade at a point adjacent the hub is greater than the pitch of the points on the face spaced outwardly thereof and the pitch at the edge of the blade is less than the pitch of the points on the face spaced inwardly thereof.

20. A propeller as set forth in claim 19 wherein, as to each blade, the pitches at all points at the leading face thereof are so related to each other that, on rotation of the propeller, plug flow of the fluid to be pumped is generated past the propeller.

* * * * *

UNITED STATES PATENT AND TRADEMARK OFFICE

CERTIFICATE OF CORRECTION

PATENT NO. : 4,647,215

DATED : March 3, 1987

INVENTOR(S) : Armitage, et al.

It is certified that error appears in the above-identified patent and that said Letters Patent is hereby corrected as shown below:

Page 1, in the ABSTRACT, line 10, delete "of rotary motion".

Col. 4, line 37, after "three", insert --warped plates or--.

Col. 6, line 26, between "oxide silica", add --/-- (slash mark).

Col. 6, line 64, change "adapter" to --adaptor--.

Col. 7, line 19, change "lease" to --least--.

Signed and Sealed this

First Day of September, 1987

*Attest:*

*Attesting Officer*

DONALD J. QUIGG

*Commissioner of Patents and Trademarks*